United States Patent [19]

Carlson

[11] 4,044,442

[45] Aug. 30, 1977

[54] METHOD OF INSTALLATION OF LARGE CAPACITY GAS-TURBINE POWERED ELECTRICAL GENERATING MACHINERY

[75] Inventor: Arne Carlson, Finspong, Sweden

[73] Assignee: Stal-Laval Turbin AB, Finspong, Sweden

[21] Appl. No.: 642,021

[22] Filed: Dec. 18, 1975

[30] Foreign Application Priority Data

Dec. 23, 1974 Sweden ..... 7416223

[51] Int. Cl.[2] ..... B23P 15/04

[52] U.S. Cl. ..... 29/156.4 R; 29/156.8 R; 29/428; 29/464; 415/126; 415/DIG. 3

[58] Field of Search ..... 29/156.4 R, 156.8 R, 29/428, 464, 467, 468; 415/DIG. 3, 219 R, 126

[56] References Cited

U.S. PATENT DOCUMENTS

| | | | |
|---|---|---|---|
| 1,893,699 | 1/1933 | Dunning | 29/428 |
| 1,923,126 | 8/1933 | Tucker | 415/DIG. 3 |
| 3,022,740 | 2/1962 | Wilfley et al. | 415/126 |
| 3,140,821 | 7/1964 | Weckwert et al. | 415/DIG. 3 |
| 3,268,206 | 8/1966 | Swinglehurst | 415/DIG. 3 |
| 3,432,911 | 3/1969 | Rodgers | 29/464 |

FOREIGN PATENT DOCUMENTS

| | | | |
|---|---|---|---|
| 200,449 | 11/1955 | Australia | 415/131 |
| 163,019 | 6/1921 | United Kingdom | 415/126 |

*Primary Examiner*—C.W. Lanham

*Assistant Examiner*—Daniel C. Crane

*Attorney, Agent, or Firm*—Pollock, Vande Sande & Priddy

[57] ABSTRACT

A method of installing into a machinery hall a gas turbine unit comprising a gas generator unit and a power turbine unit and forming a portion of a large capacity, gas-turbine powered electrical generating apparatus. The method is particularly intended for electric generating equipment having a capacity of at least 60 megawatts. To install the gas generator of such a unit in the hall and to couple it to the already-installed power turbine unit, the gas generator is moved horizontally into the machinery hall on roller devices. When the gas generator has been moved horizontally to the assembly site, some of the roller devices are removed, and concurrently with their removal a portion of the load is then transferred to an overhead travelling crane in such manner that the remaining roller devices and the overhead crane provide force couples which together support the entire weight of the gas generator and also readily permit adjustments in position of the gas generator so as to bring the central shaft pivot of the gas generator into its desired position relative to a central bearing of the power turbine unit. The method makes it possible to conveniently assemble the gas turbine unit to the power turbine unit without damage to the central bearing and without any need to provide an overhead crane of a capacity adequate to support the entire weight of the gas turbine unit.

4 Claims, 4 Drawing Figures

1
2
4
5
6
7
8
9
10
17
18
19
21
22
a
b
T
T

METHOD OF INSTALLATION OF LARGE CAPACITY GAS-TURBINE POWERED ELECTRICAL GENERATING MACHINERY

BACKGROUND OF THE INVENTION

When installing gas turbine units having a power generating capacity below 60 megawatts, the whole gas turbine can be transported and erected as a unit which has already been assembled in the factory. Such a method is not feasible, however, for apparatus whose generating capacity is in excess of 60 megawatts since, with such larger apparatus, the gas turbine is generally delivered to the installation site as two separate units comprising a gas generator unit with a combustion chamber as one unit and also a separate power turbine unit.

With such higher capacity apparatus, the gas generator is provided with a shaft which must then be appropriately coupled with a mating bearing in the power turbine unit. Incidentally, the reason that the bearing is preferably included as a part of the power turbine unit is to have the bearing at as great a distance from the combustion chamber as possible so as to avoid harmful heating of the bearing.

The fact that the shaft pivot of the gas generator during the installation in the machinery hall of the power station must be inserted into a bearing arranged in the power turbine unit, complicates the connection of the two units to a high degree. In the case of an undivided gas turbine, only two large components need be connected together, namely the gas turbine and the generator, and this is made by means of a flange connection. In the installation of the latter type apparatus, if the connected halves are not fitted together sufficiently well at the first attempt of adjusting, no harm is done. Even if the connected halves are in contact with each other it is possible to adjust them vertically and laterally relative to each other. However, in connecting the above-mentioned gas turbine units, i.e. the gas generator and power turbine, which may each weigh more than 70 tons, for example, any excessive misalignment when joining the two parts may cause severely detrimental scraping of the bearing material even before the seizure is noted.

It has been found that the above-mentioned joining of the two units may be performed with good precision if the gas generator is allowed to hand freely in space from a suitable travelling crane. It is then possible, when the units are suitably coaxially aligned, to insert the tip of the somewhat bevelled shaft pivot into the outermost end of the bearing. Adjustments in lateral and vertical direction may then be performed with the help of the travelling crane. However, such a procedure, in which a travelling crane takes up the full weight of the gas generator, although readily applicable when assembling the gas turbine in the workshop where the manufacture takes place, is not necessarily feasible when installing the turbine in a power station. Thus, to be dependent on such a procedure when the gas turbine is mounted in the power station requires that the machinery hall must then be provided with a travelling crane which is dimensioned for the weight of the gas generator, and also requires that the station building be constructed with a much stronger framework than would otherwise be necessary.

SUMMARY OF THE INVENTION

The present invention relates to a method of installing a gas turbine unit of at least 60 megawatts generating capacity in a machinery hall. The gas turbine unit comprises a power turbine unit connected to an alternating-current generator by means of a flange connection and a gas generator unit connected with said power turbine unit with regard to gas flow by means of flanges. The gas generator unit is further joined to the power turbine unit by a central shaft pivot in the gas generator which rotates within a central bearing in the power turbine unit.

The method of this invention comprises substantially a horizontal transport into the machinery hall of said A.C. generator and also said power turbine unit and positioning and adjusting these on their base plates by means of pressure-absorbing adjusting devices. Thereafter, the gas generator is transported substantially horizontally to the place of erection by means of rolling support members which are arranged below the gas generator unit in a sufficient number to provide a static equilibrium. Subsequently, those rolling support members which are disposed to one side of the center of gravity of the gas generator unit are removed and their supporting force is replaced by the upward lift provided by an overhead travelling crane. Consequently, during the remainder of the mating of the gas generator to the power turbine unit, the weight of the gas generator is borne only partially by the overhead crane while the remainder is borne by the rolling support members. In this way, the crane and the machinery has need be designed to support only a portion of the weight of the gas generator. Nevertheless, the method readily permits precise positioning adjustment of the gas generator so as to permit it to be coupled to the power turbine unit without damage to the bearing.

BRIEF DESCRIPTION OF THE DRAWINGS

In the following, the invention will be described with reference to the accompanying drawings in which.

DETAILED DESCRIPTION OF THE PREFERRED EMBODIMENTS

Figure 1:
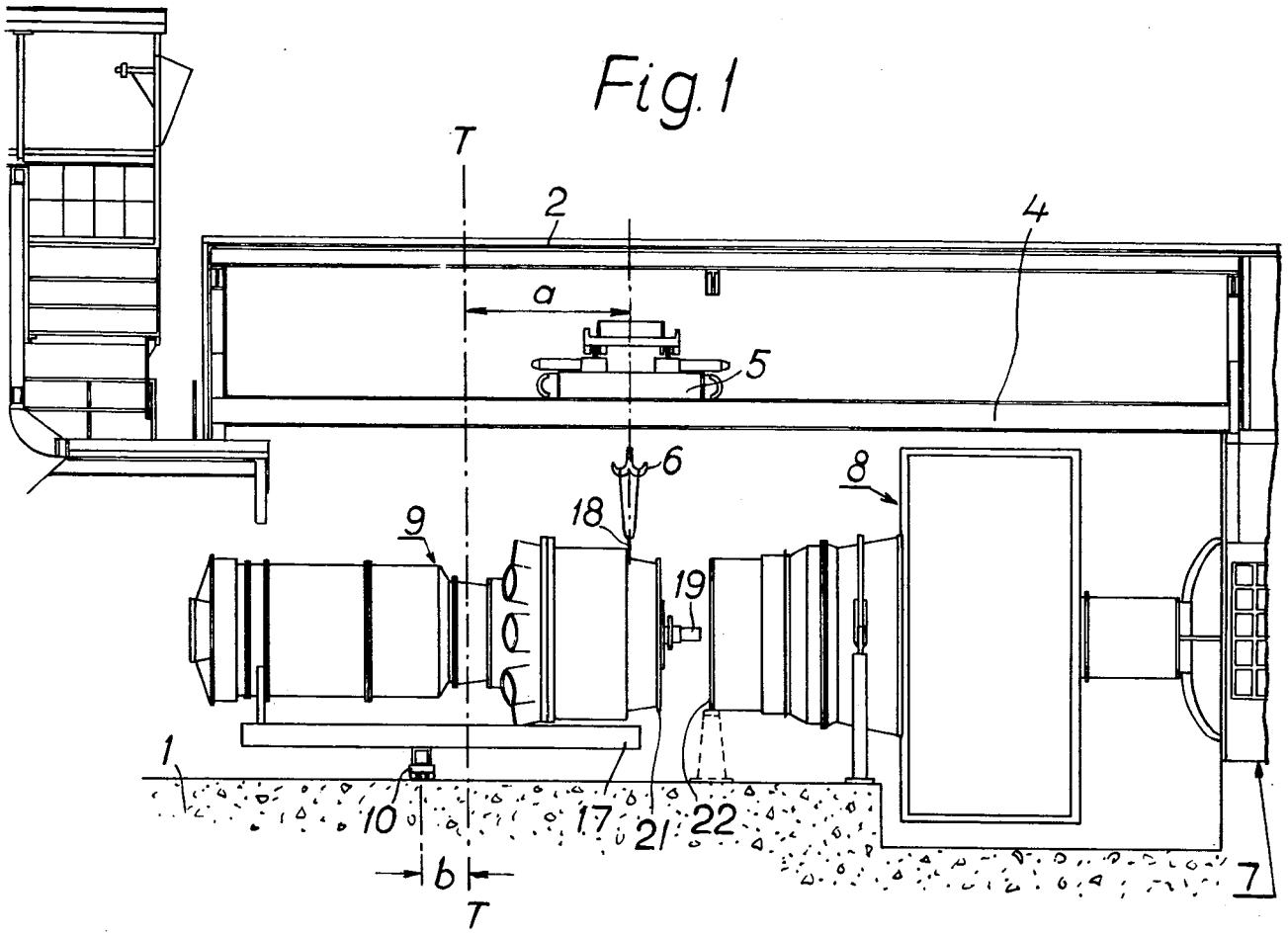
FIG. 1 shows a vertical section through a machinery hall where a gas turbine unit according to the invention is under installation.
Figure 2:
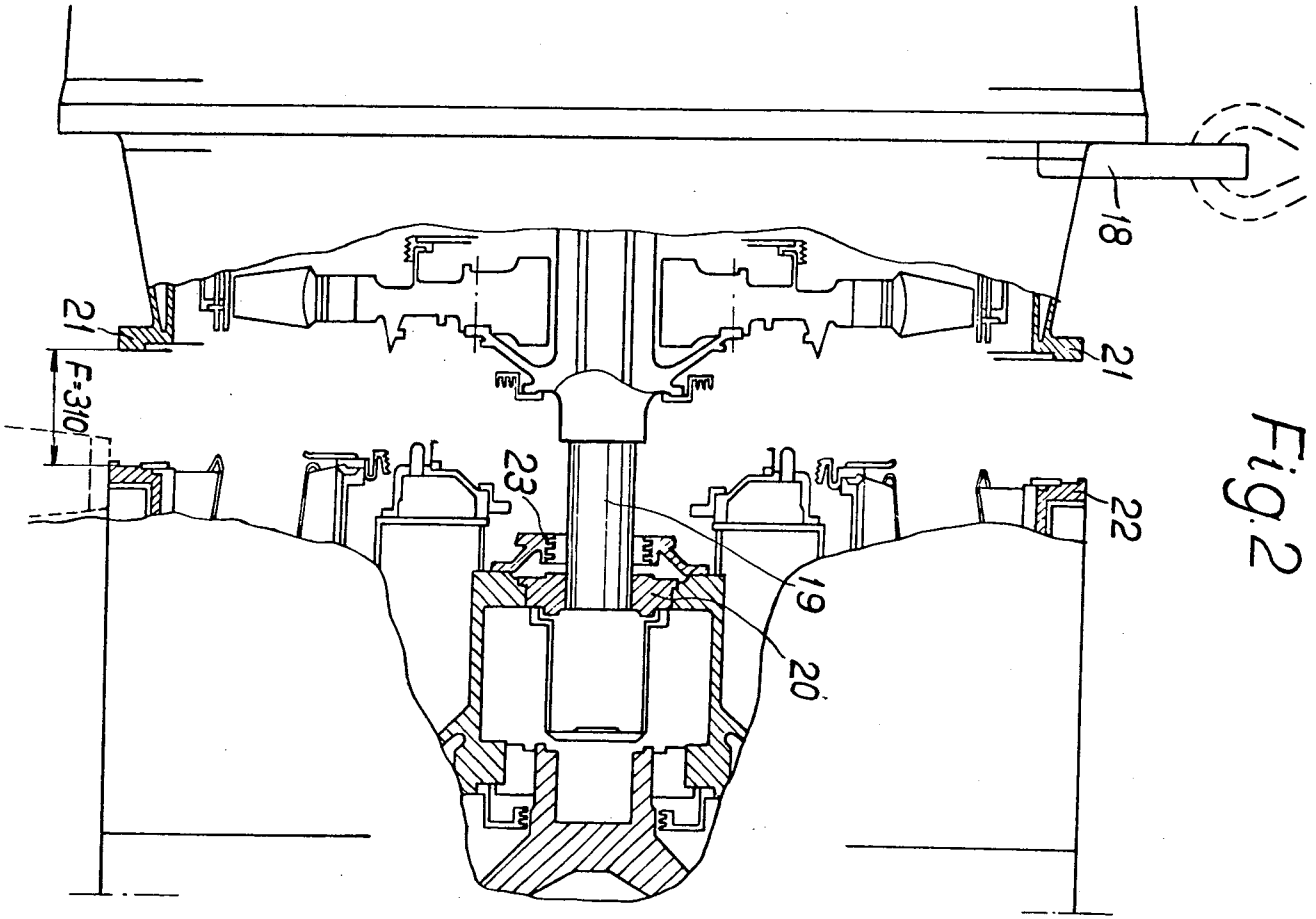
FIG. 2 shows a part of the gas turbine shown in FIG. 1, in a side view as well as in an axial section.

In the drawings, 1 designates the floor and 2 the roof of the machinery hall of a power station. The machinery hall has two long walls, each with an adjacent steel beam 4, between which a crane bridge, shown in cross-section, is supported. The bridge 5 comprises a part of a travelling crane, the grab member of which is designated 6.

At the assembly stage shown in FIG. 1, the generator 7 and the power turbine unit 8 have been shown as being moved into the machinery hall and placed on their base plates. Further, the output shaft of the power turbine unit has been connected with the input shaft of the generator by means of a flange connection.

Figure 3:
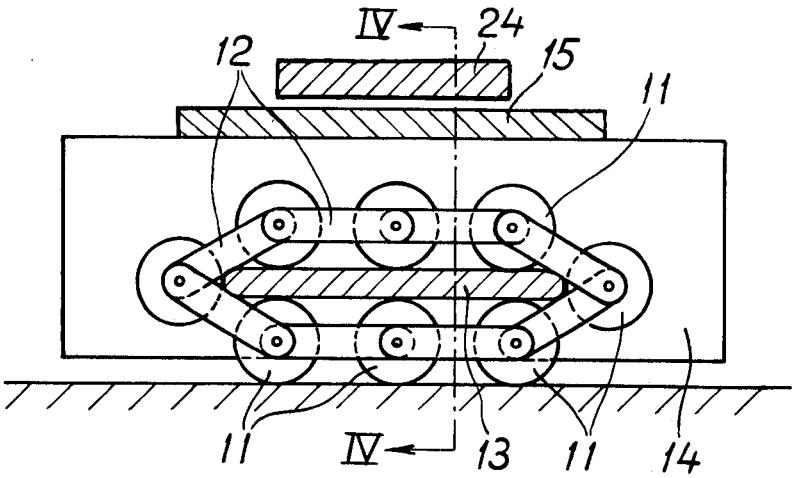
FIGS. 3 and 4 show a rolling support member of a known construction, FIG. 3 being a section in the direction of transport along the line III-III of FIG. 4, and FIG. 4 being a section along IV-IV of FIG. 3.
Figure 4:
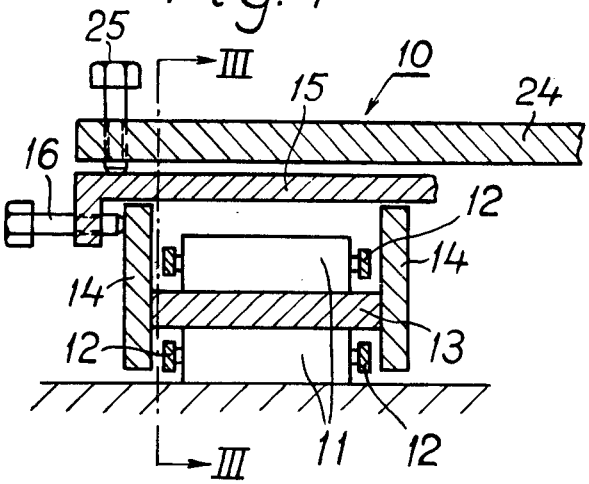

When transporting the second part of the two-part gas turbine, i.e. the gas generator unit 9, to the position where it is to be connected with the power turbine unit 8, a plurality of rolling supports is used, which are constructed as so-called "roller skates" in the example shown in the drawing. Such roller skates 10 are constructed as shown in FIGS. 3 and 4, where eight rollers 11 are connected to each other by means of sixteen links 12, thus forming an endless chain arranged to roll around a horizontal plate 13. The load is transferred to plate 13 by way of two side plates 14 welded to the plate 13, preferably by way of a slide plate 15, the lateral position of which can be adjusted by means of an adjusting screw 16, and by a plate 24, the vertical position of which is adjustable by means of a plurality of screws 25.

The gas generator unit is rolled into the machinery hall supported on a rectangular frame 17 supported by four roller skates 10, of which two are arranged at one front corner each of the frame 17. In the description provided herein, it will be assumed that the "front"direction refers to the right-hand direction in FIG. 1, i.e. toward the power turbine unit 8. The other two skates are positioned to the rear of a cross-section plane T-T which passes through the center of gravity of the gas generator unit 9. Each of the two rear pairs of roller skates is dimensioned for a carrying capacity of more than 35% of the weight of the gas generator unit, and preferably for a carrying capacity greater than 50% of this weight.

The gas generator 9 is provided at its front part with a lifting loop 18. The gas generator 9 has a shaft pivot 19 which is to be inserted into a bearing 20 of the power turbine unit 8. The part of the shaft pivot 19 which is to be led completely through the bearing 20 is at least twice as long as the bearing 20. The connection of the two units 9 and 8 also includes the flange 21 which is to be bolted to the flange 22 with a gas-tight connection. Because of the great length of the shaft pivot 19, there will be a relatively great distance between the flanges 21 and 22 when the shaft pivot 19 is inserted into the bearing 20, which makes possible measuring and control of the mutual orientation of the flanges 21 and 22. When the whole bearing surface is in contact with the shaft pivot, the distance between the flanges 21 and 22 is greater than 200 mm.

Before the shaft pivot 19 has reached the bearing opening entirely, the lifting loop 18 is connected with the grab member 6 of the travelling crane. When the crane has achieved a slight elevation of one end, i.e. the front end, of the gas generator unit, the above-mentioned roller skates arranged at the front corners of the frame 17 are removed. If the load on each roller skate is designated $P_r$ and the load on the travelling crane $P_k$, and the distances of these forces from the center of gravity plant T—T are designated b and a, respectively, the following relation applies:

$$P_k = P_r(b/a)$$

In the method according to the invention, $(b/a)$ can be chosen, for example, to be equal to 1/5. If the weight of the gas generator is 80 tons, for example, a lifting capacity of 16 tons for the travelling crane will then be sufficient. Also, lower values can be chosen for the relation $(b/a)$. Usually the crane is dimensioned for, at the most, 25% of the weight of the gas generator unit, but the method according to the invention provides considerable advantages also when the intention is to reduce the necessary crane capacity to 50%, at the most, of the weight of the gas generator unit.

When the shaft pivot has been inserted through the labyrinth seal 23 and is arranged with its somewhat conical outer surface at the opening of the bearing, its coaxial position is adjusted with the help of the adjusting screws 16 and 25, shown in FIG. 4, of the roller skates 10, and by means of the travelling crane. A criterion of the the correct positioning of the gas generator is that the distance between the flanges 21 and 22 shall be constant along the circumference of the connection. This is measured and adjusted numerous times during the insertion of the shaft pivot 19 into the bearing 20.

According to another embodiment of the invention, a low car is used instead of the frame 17, and the gas generator unit is supported at the beginning by two pairs of non-rotative supports which are arranged on the car.

I claim

1. A method of installing in a machinery hall a gas turbine apparatus for coupling mechanically to an electric power generator, the gas turbine comprising a power turbine unit whose output shaft is coupled to the input shaft of the generator and also comprising as a separate unit a gas generator unit which is to be connected to the power turbine with a gas-tight fitting by means of respective cooperating flanges and also with a protruding axial shaft on the gas generator which mates with a bearing in the power turbine unit, said method comprising the steps of:

fixedly installing on supporting means in the machinery hall the power turbine unit and coupling said power turbine unit to the generator with the said bearing of said power turbine unit being oriented horizontally for coaxial alignment with said shaft of said gas generator, transporting the gas generator into the machinery hall and to the site of its assembly with the power turbine unit by rolling the gas generator horizontally on a plurality of roller means and with its entire weight supported in static equilibrium on the roller means, lifting one end of the gas generator slightly so as to permit the removal from thereunder of sufficient of the roller means to ensure that the roller means remaining do not provide static equilibrium of the gas generator, concurrently with the lifting step, supporting a portion of the weight of the gas generator from an overhead travelling crane which is attached to the gas generator at a point to provide, in cooperation with said remaining roller means, static equilibrium support of the gas generator, and repeatedly adjusting the height of said roller means and also the extent of lift provided by the travelling crane while concurrently moving said gas generator horizontally to bring the cooperating flanges on the gas generator and power turbine unit into abutting relationship with each other while said shaft concurrently is coaxially aligned with said bearing.

2. The method of claim 1 in which the roller means remaining under the gas generator and also the position of attachment of a grab member of the travelling crane onto the gas generator are so selected relative to its center of gravity that no more than fifty percent of the weight of the gas generator is supported by said travelling crane.

3. The method of claim 1 in which the roller means remaining under the gas generator and also the position of attachment of a grab member of the travelling crane onto the gas generator are so selected relative to its center of gravity that no more than twenty-five percent of the weight of the gas generator is supported by said travelling crane.

4. The method of claim 1 in which after each repeated adjustment step the distance between the opposing flanges is measured at a plurality of circumferentially space locations about said flanges and the subsequent adjustment step is selected so as to equalize such distance measurements.

* * * * *